US010321790B2

(12) United States Patent
Schalitz et al.

(10) Patent No.: US 10,321,790 B2
(45) Date of Patent: Jun. 18, 2019

(54) DISPOSABLE SOAP DISPENSER

(71) Applicants: William J. Schalitz, Swanton, OH (US); Vishaal B. Verma, Evanston, IL (US)

(72) Inventors: William J. Schalitz, Swanton, OH (US); Vishaal B. Verma, Evanston, IL (US)

(73) Assignee: Spartan Chemical Company, Inc., Maumee, OH (US)

( * ) Notice: Subject to any disclaimer, the term of this patent is extended or adjusted under 35 U.S.C. 154(b) by 0 days.

(21) Appl. No.: 15/217,128

(22) Filed: Jul. 22, 2016

(65) Prior Publication Data

US 2017/0020348 A1 Jan. 26, 2017

Related U.S. Application Data

(60) Provisional application No. 62/195,841, filed on Jul. 23, 2015.

(51) Int. Cl.

| | |
|---|---|
| ***A47K 5/12*** | (2006.01) |
| ***B05B 15/62*** | (2018.01) |
| ***B05B 11/00*** | (2006.01) |
| ***A47K 5/16*** | (2006.01) |
| ***B05B 7/00*** | (2006.01) |
| *A47K 5/13* | (2006.01) |

(52) U.S. Cl.

CPC ..... *A47K 5/1211* (2013.01); *A47K 5/16* (2013.01); *B05B 7/0062* (2013.01); *B05B 11/007* (2013.01); *B05B 11/00442* (2018.08); *B05B 11/3014* (2013.01); *B05B 11/3025* (2013.01); *B05B 11/3087* (2013.01); *B05B 15/62* (2018.02); *A47K 5/1207* (2013.01); *A47K 5/13* (2013.01)

(58) Field of Classification Search

CPC ..... A47K 5/1211; A47K 5/14; A47K 5/16; A47K 5/1207; A47K 5/13; B05B 15/061

See application file for complete search history.

(56) References Cited

U.S. PATENT DOCUMENTS

| | | | | |
|---|---|---|---|---|
| 813,537 | A * | 2/1906 | Townsend | 248/222.11 |
| 3,032,081 | A * | 5/1962 | La Cotta | A47K 5/00 141/362 |
| 3,096,913 | A * | 7/1963 | Clifton | A47K 5/18 215/378 |
| D210,567 | S * | 3/1968 | Stanziale | D6/545 |

(Continued)

OTHER PUBLICATIONS

International Search Report for PCT/US2016-043574 dated Oct. 20, 2016.

(Continued)

*Primary Examiner* — Paul R Durand
*Assistant Examiner* — Randall A Gruby
(74) *Attorney, Agent, or Firm* — Shumaker, Loop & Kendrick, LLP

(57) ABSTRACT

A soap dispenser including a rigid cartridge, an inverted dispensing pump, a collar carrying a lever for actuating the pump, and a venting system for equalizing the air pressure in the rigid cartridge, wherein the rigid cartridge and the collar cooperate to removably attach the soap dispenser to a wall-mounted bracket, and further wherein at least the rigid cartridge is disposable and can be made of a recyclable and/or biodegradable material.

14 Claims, 10 Drawing Sheets

(56) References Cited

U.S. PATENT DOCUMENTS 3,540,630 A * 11/1970 Brown ..... A47K 5/1204 222/153.03
3,589,338 A * 6/1971 Lovitz ..... A01K 1/0356 119/51.01
4,077,549 A * 3/1978 Beard ..... B05B 11/3057 222/321.8
4,149,573 A * 4/1979 Cassia ..... A47K 5/1208 141/114
4,164,306 A * 8/1979 Perrin ..... A47K 5/12 141/375
4,166,553 A * 9/1979 Fraterrigo ..... A47K 5/122 222/181.2
4,360,130 A * 11/1982 Nishimura ..... A47K 5/1204 222/153.09
4,425,012 A * 1/1984 Kley ..... A47K 10/24 211/105.3
4,615,467 A * 10/1986 Grogan ..... B05B 11/043 222/190
4,621,749 A * 11/1986 Kanfer ..... A47K 5/1215 222/153.01
4,673,109 A * 6/1987 Cassia ..... A47K 5/1209 222/153.03
4,957,260 A * 9/1990 Shelley ..... A47K 5/18 141/352
5,174,476 A * 12/1992 Steiner ..... A47K 5/1209 222/181.2
5,183,182 A * 2/1993 Comstock ..... A47K 5/12 222/129
5,226,625 A * 7/1993 Hanna ..... A47K 5/12 248/222.13
5,421,489 A * 6/1995 Holzner, Sr. ..... A47K 5/1208 222/181.2
5,489,044 A * 2/1996 Ophardt ..... A47K 5/1205 222/1
5,494,250 A * 2/1996 Chen ..... A47K 10/185 248/316.7
5,613,625 A * 3/1997 Specht ..... A47K 5/12 222/180
5,632,418 A * 5/1997 Brown ..... A47K 5/1202 222/153.09
5,725,131 A * 3/1998 Bell ..... A47K 5/10 222/181.3
5,826,755 A * 10/1998 Burd ..... A47K 5/1208 222/309
5,975,360 A * 11/1999 Ophardt ..... A47K 5/1205 222/181.1
6,042,076 A * 3/2000 Moreno ..... B60R 1/04 248/222.11
6,082,586 A * 7/2000 Banks ..... A47K 5/14 222/105
6,129,221 A * 10/2000 Shaha ..... A47B 81/00 211/87.01
6,209,184 B1 * 4/2001 Copeland ..... A47K 5/12 264/219
6,321,943 B1 * 11/2001 Strickler ..... A47K 5/1204 222/156
D454,017 S * 3/2002 Kauzlarich ..... D6/545
6,409,050 B1 * 6/2002 Ophardt ..... A47K 5/14 222/181.1
6,543,651 B2 * 4/2003 Lewis ..... A47K 5/1204 222/156
6,572,063 B1 * 6/2003 Gitelman ..... A61C 15/043 248/205.3
6,604,693 B2 * 8/2003 Santagiuliana ..... B05B 7/0037 222/190
6,612,468 B2 * 9/2003 Pritchett ..... B05B 7/0037 222/190
6,805,264 B2 * 10/2004 Houvras ..... B65D 23/003 222/180
7,004,356 B1 * 2/2006 Sayers ..... B05B 7/0037 222/137
7,066,356 B2 * 6/2006 Schuman ..... A47K 5/14 222/153.01
7,261,268 B2 * 8/2007 Kunesh ..... A45D 27/22 206/228
7,290,683 B2 * 11/2007 Gerenraich ..... B65D 23/003 222/153.03
7,325,704 B2 * 2/2008 Kasting ..... B05B 11/0016 222/321.4
8,496,142 B2 * 7/2013 Uehira ..... B05B 11/0064 222/190
8,662,355 B2 * 3/2014 Spiegelberg ..... A47K 5/14 222/145.5
8,672,187 B2 * 3/2014 Ophardt ..... A47K 5/1217 222/145.5
D713,264 S * 9/2014 Geiberger ..... D9/682
D773,850 S * 12/2016 Schalitz ..... D6/542
2002/0070240 A1 * 6/2002 Dorman ..... A47K 5/1211 222/209
2002/0108968 A1 * 8/2002 Dumont ..... B01F 5/0696 222/136
2004/0099623 A1 * 5/2004 Kurtz ..... A47K 10/20 211/85.17
2005/0051579 A1 * 3/2005 Kasting ..... B05B 11/0059 222/321.7
2005/0072805 A1 * 4/2005 Matthews ..... B05B 11/0016 222/190
2005/0077385 A1 * 4/2005 Chen ..... A47K 5/12 239/302
2005/0284887 A1 * 12/2005 Lewis ..... B05B 7/0037 222/181.3
2006/0113327 A1 * 6/2006 Walters ..... B05B 11/3014 222/153.11
2006/0138176 A1 * 6/2006 Lasserre ..... B05B 11/3057 222/321.8
2007/0257061 A1 * 11/2007 Ophardt ..... A47K 5/12 222/181.3
2008/0083786 A1 * 4/2008 Marin ..... A47K 5/122 222/181.3
2009/0145296 A1 * 6/2009 Ophardt ..... A47K 5/1207 92/240
2009/0302067 A1 * 12/2009 Hendrickx ..... A47K 5/1207 222/321.8
2009/0308894 A1 * 12/2009 Ophardt ..... A47K 5/14 222/190
2011/0101029 A1 * 5/2011 Lewis, II ..... A47K 5/1202 222/153.03
2011/0284592 A1 * 11/2011 Alluigi ..... B05B 11/3025 222/321.8
2012/0199609 A1 8/2012 Schwenkenberg
2012/0241477 A1 * 9/2012 Uehira ..... B05B 11/0064 222/190
2013/0092708 A1 * 4/2013 Geiberger ..... A47K 5/122 222/153.03
2016/0242528 A1 * 8/2016 Schmitz ..... B05B 11/3014
2017/0055782 A1 * 3/2017 Ophardt ..... A47K 5/1207

OTHER PUBLICATIONS

Notice of Acceptance dated Feb. 7, 2019 for Australian Patent Application No. 2016297166 and Marked-Up version of Allowed claims (7 pgs.).

* cited by examiner

DISPOSABLE SOAP DISPENSER

CROSS-REFERENCE TO RELATED APPLICATION

This application claims priority from U.S. Application No. 62/195,841 filed Jul. 23, 2015, which is incorporated by reference herein in its entirety.

TECHNICAL FIELD AND BACKGROUND

The present invention relates generally to the field of soap dispensers, and more particularly, to a wall-mounted soap dispenser having a disposable cartridge and an inverted dispensing pump.

Wall-mounted soap dispensers are commonplace in public bathrooms and other locales to promote good sanitary practices. Conventional soap dispensers typically include a reservoir in the form of a bag-like bladder filled with soap and disposed within a protective housing, or alternatively, a rigid housing that concurrently functions as a reservoir. Conventional soap dispensers require periodic refilling, which entails accessing the housing and either replacing the bag-like bladder or pouring soap directly into the reservoir housing. Refilling soap can be a laborious and time-consuming process, and refillable containers suffer from accumulation and build-up of soap residue both internally and externally which can affect dispenser performance and create an aesthetically displeasing appearance.

Prolonged use of conventional wall-mounted soap dispensers further results in undesired wear-and-tear leading to, for example, a defaced external appearance of the soap dispenser and improperly functioning pump incapable of dispensing soap as desired. Thus, conventional wall-mounted soap dispensers must undergo constant routine maintenance to ensure optimal operability and appearance. Accordingly, what are needed are improvements to conventional wall-mounted soap dispensers.

BRIEF SUMMARY OF THE INVENTION

It is therefore an object of the invention to provide a wall-mounted soap dispenser that overcomes the disadvantages of conventional wall-mounted soap dispensers.

It is a further object of the invention to provide a wall-mounted soap dispenser having a reusable mounting bracket generally concealed from view behind a disposable cartridge, such that each cartridge replacement gives the appearance of an entirely new soap dispenser.

It is a further object of the invention to provide an environmentally conscious soap dispenser in that at least the disposable cartridge is made from recyclable and/or biodegradable materials.

It is a further object of the invention to provide a wall-mounted soap dispenser having an inverted dispensing pump configured to dispense foaming hand soap, which lathers more easily and requires less soap per hand washing session than liquid hand soap.

To achieve the foregoing and other objects and advantages, in a first embodiment the present invention provides a soap dispenser including a mounting bracket having a lip and a catch at opposite ends thereof, a rigid disposable cartridge having a neck end, an elongate recess formed in a backside, and a catch formed at one end of the elongate recess, a collar adapted to engage with the catch of the mounting bracket and engage with the neck end of the disposable cartridge, an inverted dispensing pump received within the neck end of the disposable cartridge and adapted to engage within the collar, and a lever carried by the collar and arranged to actuate the inverted dispensing pump to cause the inverted dispensing pump to dispense foam soap.

In a further embodiment, the lip, the catch formed at one end of the elongate recess, the collar, and the catch of the mounting bracket can together removably secure the disposable cartridge to the mounting bracket.

In a further embodiment, the mounting bracket can be an elongate member affixed to a plate for spacing the disposable cartridge apart from a wall.

In a further embodiment, a sloped protrusion can be formed on the backside of the disposable cartridge within the elongate recess that engages within a complementary-shaped sloped recess formed in a front face of the mounting bracket.

In a further embodiment, the collar can include at least one laterally extending hook adapted to snap fit engage with the catch of the mounting bracket, and wherein the lever is pivotally carried on the collar, engages an end of a nozzle of the inverted dispensing pump, and pivots to urge the nozzle axially upward.

In a further embodiment, the inverted dispensing pump can include a vent gasket arranged around an end of a pump body having an internal air chamber, the vent gasket covering a vent opening through a sidewall of the pump body, the vent gasket being an elastomer such that vacuum pressure within the rigid disposable cartridge causes the vent gasket to deflect apart from the vent and an to be drawn in through the vent into the rigid disposable cartridge to equalize air pressure therein.

In a further embodiment, the pump body can include a valve at one end thereof for drawing liquid soap into a fluid chamber, wherein the valve is an umbrella valve or a duckbill valve.

In a further embodiment, the air chamber and the liquid chamber can be formed within the pump body and can be separated by a piston having a sliding seal, and wherein a fluid inlet allows liquid soap to enter into the liquid chamber through the valve, an air inlet valve allows air to enter into the air chamber, and an air outlet valve allows air to exit the air chamber.

In a further embodiment, the sliding seal can be made of low density polyethylene.

In a further embodiment, the disposable cartridge can be made of a recyclable and/or biodegradable material.

In another embodiment the present invention provides a soap dispenser including a rigid cartridge having an internal reservoir adapted to contain a volume of liquid soap, a collar adapted to removably attach to a neck end of the rigid cartridge, an inverted dispensing pump held within the collar and received within the neck end of the rigid cartridge, and a lever carried by the collar and arranged to actuate the inverted dispensing pump to cause the inverted dispensing pump to dispense foam soap, wherein the inverted dispensing pump includes a vent gasket arranged around an end of a pump body having an internal air chamber, the vent gasket covering a vent opening through a sidewall of the pump body, the vent gasket being an elastomer such that vacuum pressure within the rigid disposable cartridge as a result of liquid soap removal causes the vent gasket to deflect apart from the vent and air to be drawn in through the vent into the rigid cartridge to equalize air pressure therein.

In a further embodiment, the soap dispenser can include a mounting bracket adapted to be received in a recess on a backside of the rigid cartridge, the mounting bracket comprises a lip and a catch at opposite ends thereof for engaging with a respective catch on the backside of the rigid cartridge and a feature on the collar to cooperatively secure an assembled configuration of the rigid cartridge, the inverted dispensing pump, and the collar to the mounting bracket.

In a further embodiment, the mounting bracket can be an elongate member affixed to a plate for spacing the rigid cartridge apart from a wall to which the plate is affixed.

In a further embodiment, the inverted dispensing pump can include a valve at one end of the pump body for drawing the liquid soap into an internal fluid chamber within the pump body, a sleeve received over a valve end of the pump body, a piston disposed within the pump body and having a sliding seal, the piston and the sliding seal separating the air chamber from the fluid chamber, a spring arranged to bias the piston, a plunger sleeve, a mesh assembly, and a nozzle.

In a further embodiment, the sliding seal can be made of low density polyethylene.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects, and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
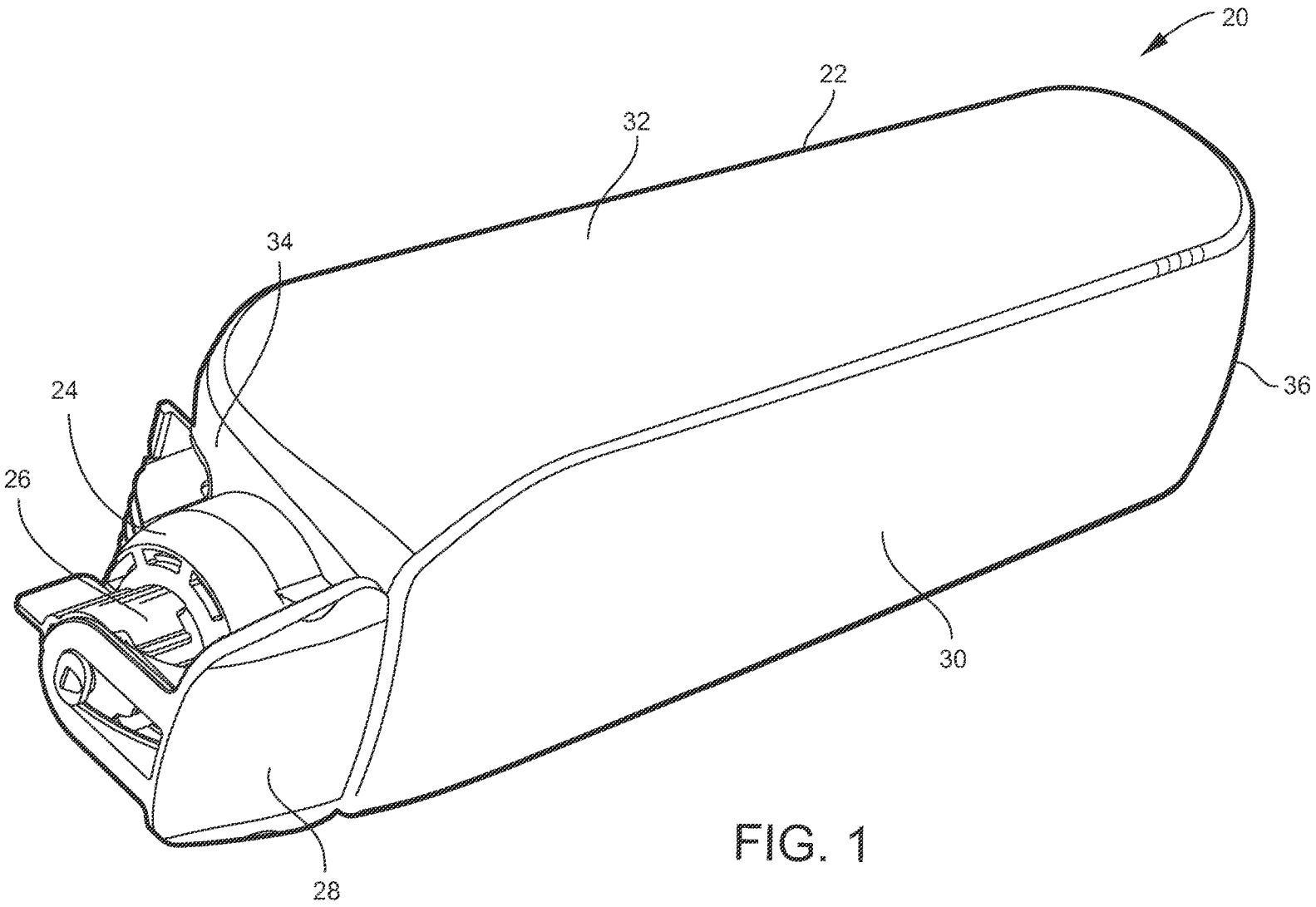
FIG. 1 is a front perspective view of a soap dispenser according to one embodiment.
Figure 2:
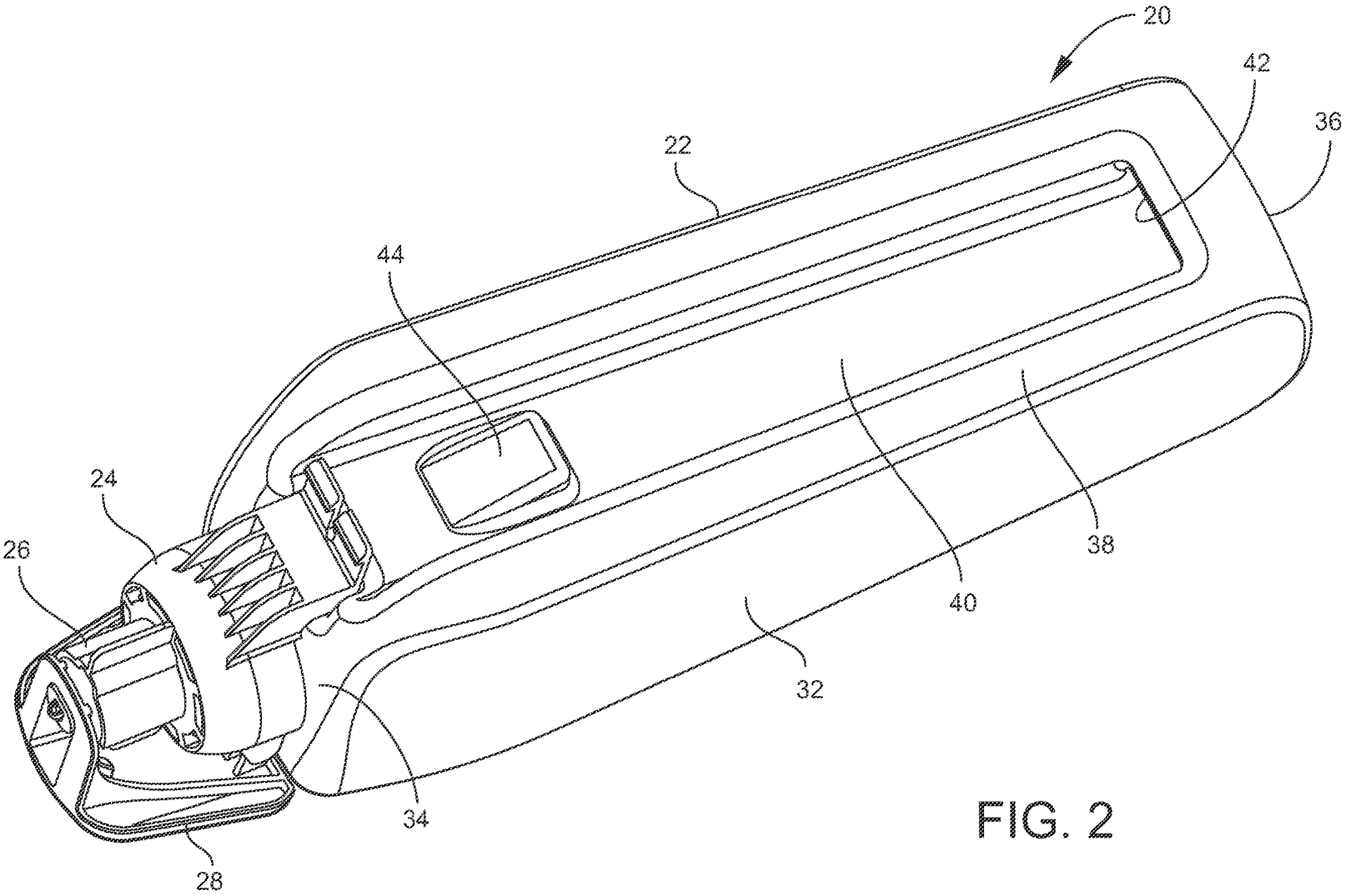
FIG. 2 is a back perspective view of the soap dispenser.

FIGS. 1 and 2 show a preferred embodiment of a soap dispenser 20 generally including a disposable cartridge 22, a collar 24, a dispensing pump 26, and a lever 28. The soap dispenser 20 is configured to mount/secure to a wall-mounted bracket, as described in detail below, with the disposable cartridge 22 preferably oriented vertically and the dispensing pump 26 inverted. In use, the wall-mounted bracket can remain affixed to the wall, generally concealed behind the disposable cartridge 22, while at least one of the disposable cartridge 22, collar 24, dispensing pump 26 and lever 28 are replaced as needed. The collar 24, dispensing pump 26 and lever 28 can be reused with each new cartridge installation, or alternatively, can be replaced with each new cartridge installation. The dispensing pump 26 is operable for dispensing soap, and is preferably configured to dispense foamed soap by combining liquid soap and air, as discussed in detail below.

The disposable cartridge 22 is preferably a rigid container (i.e., not collapsible) having an internal reservoir for containing a volume of liquid soap. The disposable cartridge 22 can be a unitary component formed by blow molding, injection molding, or any combination thereof from a suitable biodegradable material, recyclable material, or a combination thereof. Examples of suitable biodegradable and/or recyclable materials include, but are not limited to, polymers or co-polymers including polyethylene (e.g., high density polyethylene (HDPE), low density polyethylene (LDPE), or combinations thereof), polypropylene, polyethylene terephthalate, and combinations thereof. These polymers and co-polymers can each have a density preferably ranging from 0.8 to 1.0 g/cm$^3$, 0.85 to 0.95 g/cm$^3$, or 0.9 to 0.95 g/cm$^3$ and a flexural modulus ranging from 1000 MPa to 1500 MPa, from 1050 MPa to 1450 MPa, from 1100 MPa to 1400 MPa, 1100 MPa to 1200 MPa, or from 1300 MPa to 1400 MPa. In certain aspects, these biodegradable and/or recyclable materials allow for optimal post-consumer disposal. The disposable cartridge 22 can come pre-filled and sealed.

The disposable cartridge 22 as shown has a substantially planar front face 30, substantially planar sides 32, a neck end 34, a top 36, and a back side 38, although other shapes are envisioned. An elongate recess 40 is formed in the back side 38 and extends from nearly the neck end 34 to the top 36. A catch 42 formed near the end of the elongate recess 40 near the top 36 engages with a lip formed along the top of the mounting bracket as discussed below. A protrusion 44 can be formed in the elongate recess 40 proximate the neck end 34 and can be sloped/inclined toward to the top 36. The protrusion 44 can engage within a complementary-shaped recess formed in a front face of the mounting bracket to help align the disposable cartridge 22 with the mounting bracket, among other purposes. The elongate recess 40 is generally centered along the longitudinal axis of the disposable cartridge 22 and has a width less than the width of the disposable cartridge and a depth substantially equivalent to a depth of the mounting bracket. Thus, the elongate recess 44 and the mounting bracket are complementary-shaped to provide a tight fit engagement.

Figure 5:
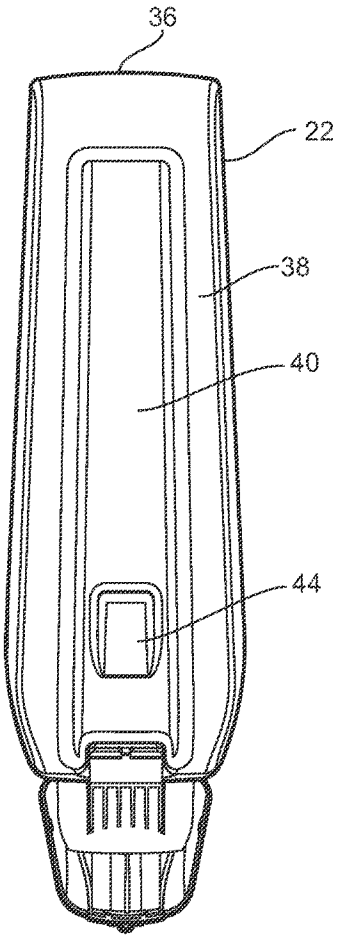
FIG. 5 is a back view of the soap dispenser.
Figure 4:
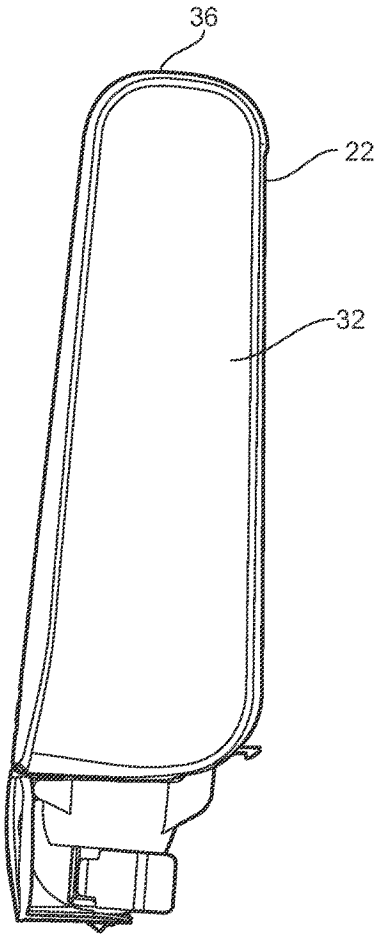
FIG. 4 is a side view of the soap dispenser.
Figure 3:
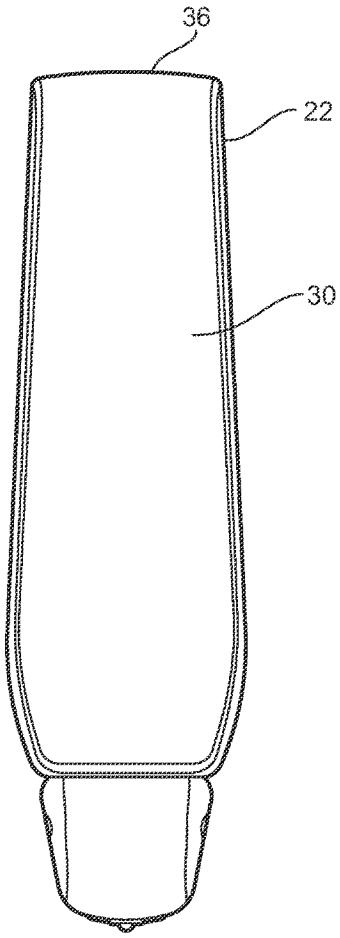
FIG. 3 is a front view of the soap dispenser.

FIGS. 3-5 show the respective front face 30, right side 32, and back side 38 of the disposable cartridge 22. As best shown in FIG. 3, the disposable cartridge can taper in width toward the top 36. As best shown in FIG. 4, the disposable cartridge 22 can taper in thickness toward the top 36. As best shown in FIG. 5, the elongate recess 40 can compose nearly half of the back side 38, and the catch 42 and the protrusion 44 are spaced apart along the length of the elongate recess.

Figure 6:
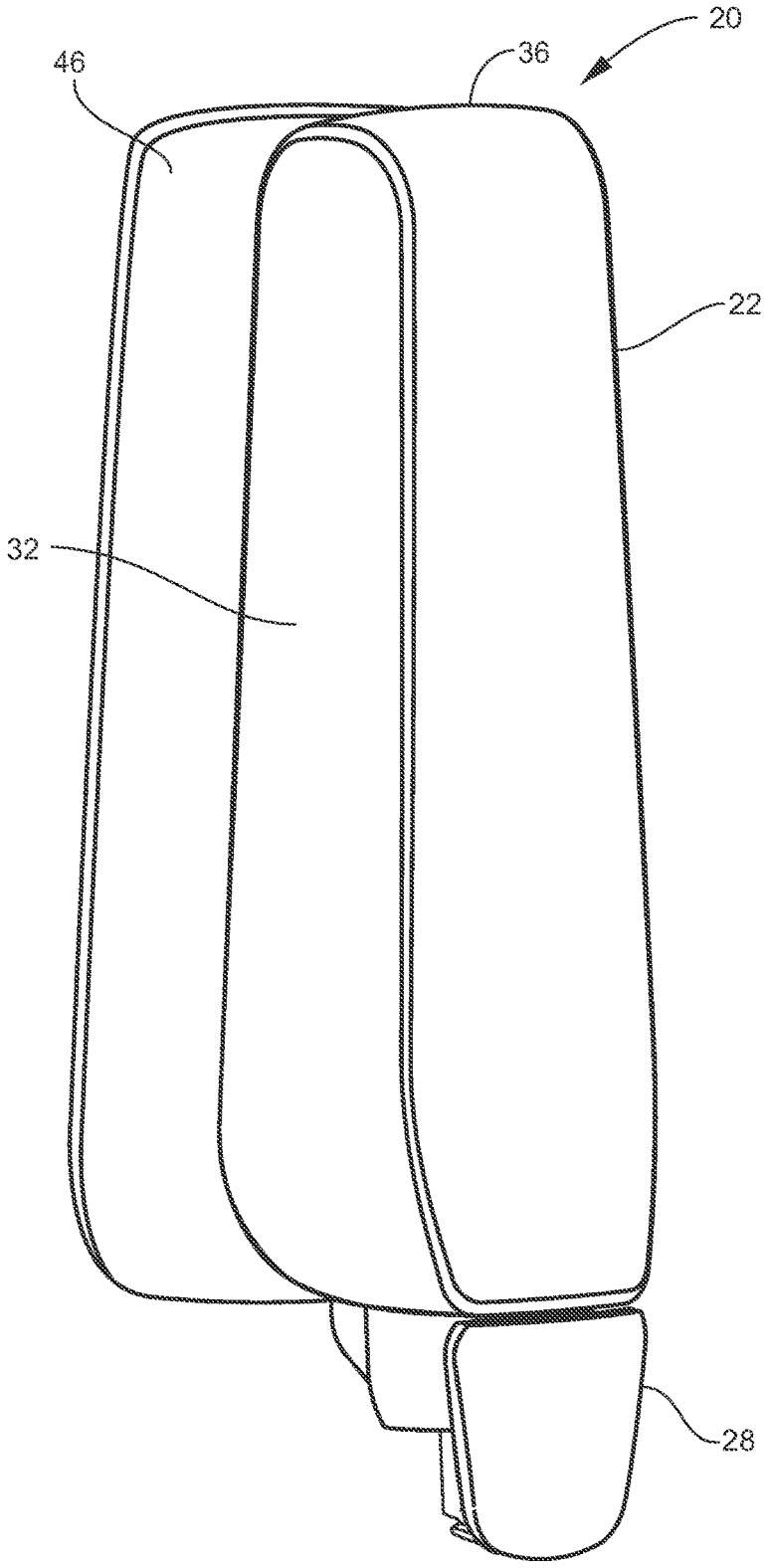
FIG. 6 is a front perspective view showing the soap dispenser secured to a mounting plate and bracket.

FIG. 6 shows the disposable cartridge 22 secured to the mounting bracket, thereby concealing the mounting bracket from view from the top 36, sides 32, and neck end 34. The mounting bracket can be affixed to a plate 46 adapted to be mounted against a wall, thereby spacing the soap dispenser 20 apart from the wall. The lever 28 and pump end extend below the bottom edge of the plate 46 to leave unobstructed the space behind the pump for placing a user's hands in position to receive the foam soap. The plate 46 can have any predetermined shape and/or thickness to achieve a desired look and spacing distance from the wall. The corners of the disposable cartridge 22 and the plate 46 can be curved for aesthetics and avoidance of sharp corners.

Figure 7:
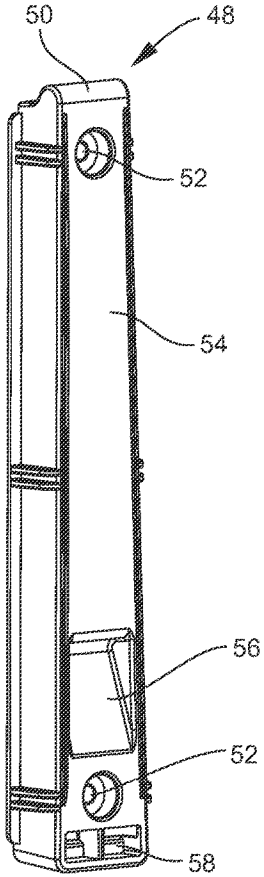
FIG. 7 is a front perspective view of a mounting bracket.

FIG. 7 shows a mounting bracket 48 according to a preferred embodiment. The mounting bracket 48 can be an elongate member having a generally rectangular shape. The lip 50 formed along the top edge engages with the catch 42 near the top of the elongate recess 40 in order to "hang" the disposable cartridge on the mounting bracket 48 while resisting downward and outward pulling forces that could dislodge the disposable cartridge from the mounting bracket. Spaced openings 52 are provided through the front face 54 of the mounting bracket near the top and bottom ends for receiving fasteners therethrough for securing the mounting bracket to the wall. Suitable fasteners include, but are not limited to, screws, nails and like fasteners. Adhesive tape provided on the back side of the mounting bracket can also be used to secure the mounting bracket to the wall. A sloped recess 56 on the front face 54 receives the complementary shaped protrusion on the back side of the disposable cartridge. A catch 58 provided near the bottom of the mounting bracket 48 is provided to engage with one or more deflectable hooks on the collar as the hooks slide past the catch to retain the collar to the mounting bracket, as discussed in detail below.

Figure 8:
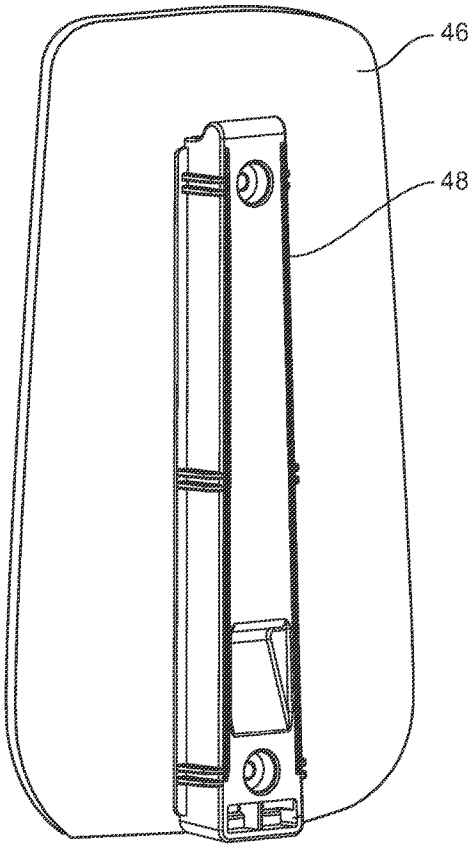
FIG. 8 is a front perspective view of the mounting bracket affixed to a mounting plate.

FIG. 8 shows the mounting bracket 48 affixed to the plate 46. While the mounting bracket 48 can be used alone as shown in FIG. 7 to flush-mount the soap dispenser against the wall, the plate 46 shown in FIG. 8 can be used to space the soap dispenser apart from the wall. When installed on the mounting plate 48, the fastener openings 52 are concealed from view, thereby discouraging tampering and removal of the assembly. The front face of the mounting bracket can be oriented vertically, or can be oriented at an angle to vertical to orient the front face of the disposable cartridge at a predetermined angle. The sloped recess 56 of the mounting bracket 48 can have a downwardly-extending lip along a top thereof, and the corresponding protrusion 44 can have an upwardly-extending protrusion, such that the lip of the protrusion is required to be forced past the lip of the recess to fully engage the protrusion within the recess, thereby resisting outward pulling forces on the disposable cartridge.

Figure 9:
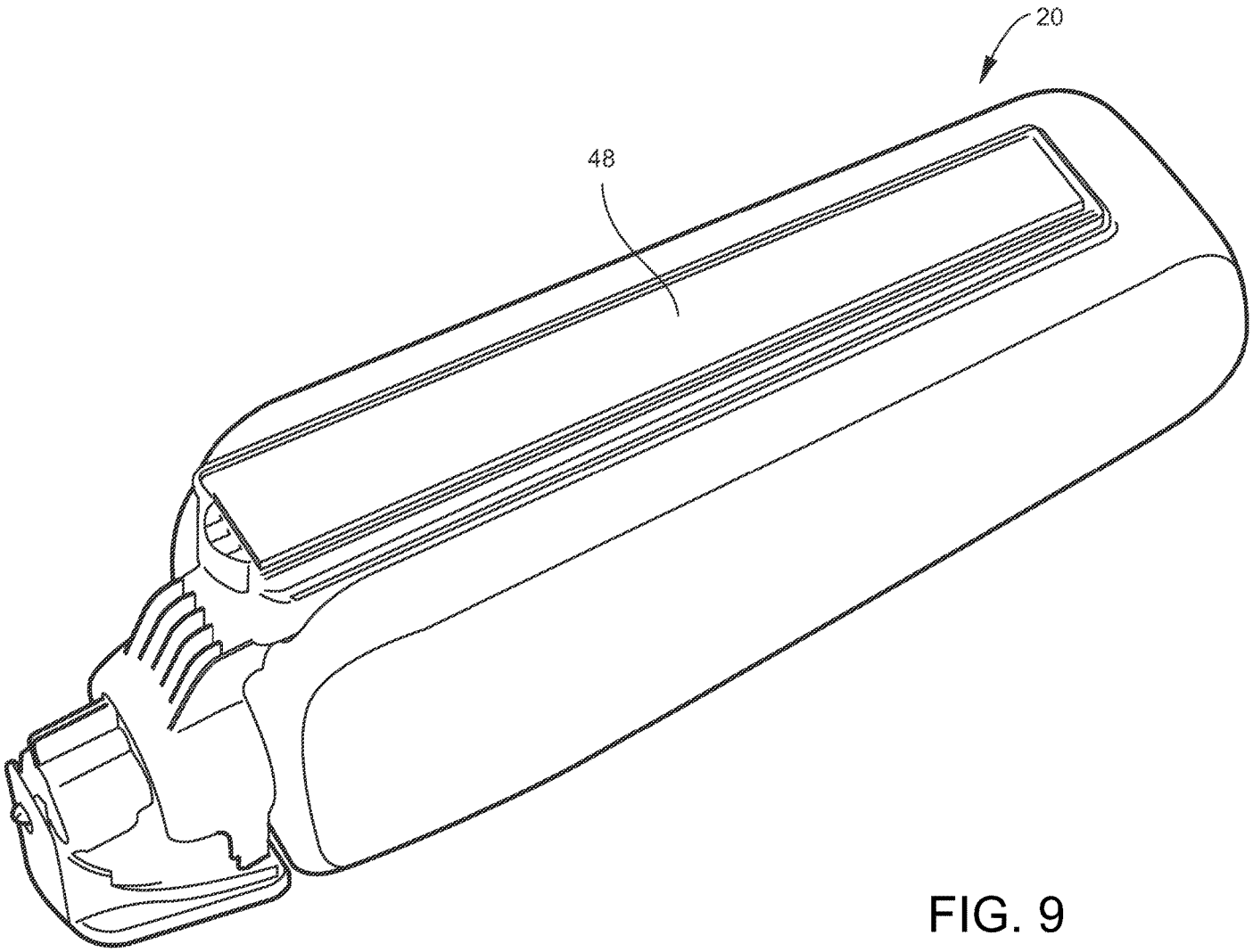
FIG. 9 is a back perspective view showing the soap dispenser secured to the mounting bracket.

FIG. 9 shows the soap dispenser mounted to the mounting bracket 48. The mounting bracket 48 is shown without the plate, thus configured for flush-mounting directly against the wall.

Figure 12:
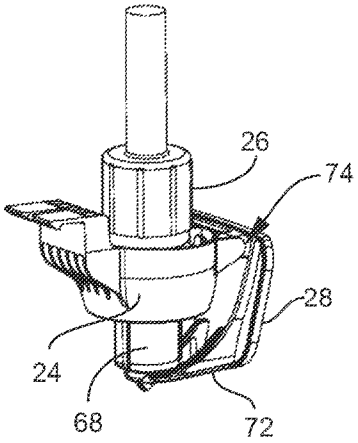
FIG. 12 is a perspective view showing the dispensing pump attached to the collar.
Figure 11:
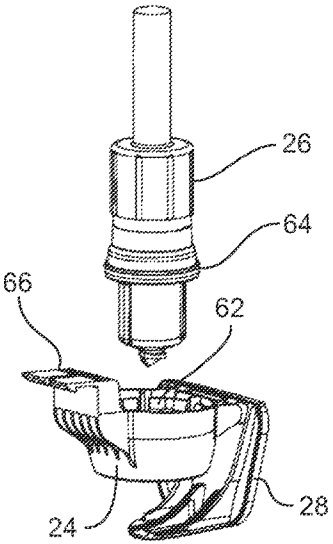
FIG. 11 is a perspective view showing the dispensing pump detached from the collar.
Figure 10:
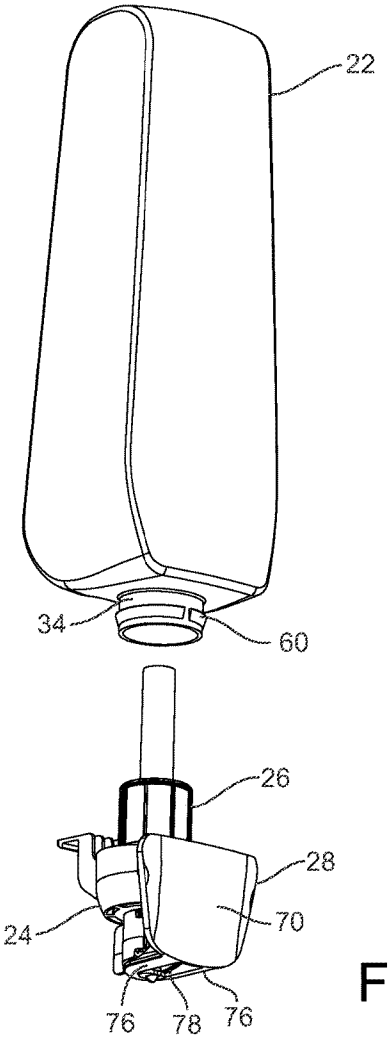
FIG. 10 is a perspective view showing the cartridge detached from the dispensing pump.
Figure 13:
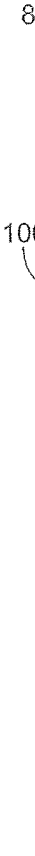
FIG. 13 is a front view of a dispensing pump according to a first embodiment.

FIGS. 10-12 show various attached and detached configurations of the disposable cartridge 22, the collar 24, and the dispensing pump 26. The neck end 34 of the disposable cartridge 22 can be configured for annular snap-fit engagement with the collar 24. Annular snap joints are preferable for assembling the cylindrical profiles of the neck end 34 and the collar 24. A sloped interference ring 60 can be provided around the outer circumference of the neck end, while another sloped interference ring 62 or bead can be provided around the inner circumference of the collar 24. The interference rings 60, 62 of the neck end 34 and the collar 24 can be continuous or discontinuous, with the discontinuous ring of the collar 24 provided as independently deflectable tabs. The neck end 34 can be made from a more rigid material than the collar 24 in order to deflect the collar tabs outward to fully insert the neck end into the collar.

As best shown in FIG. 11, the dispensing pump 26 can also include an annular ring 64 required to be forced past an inner bead or deflecting tabs to retain the dispensing pump within the collar. At least one laterally extending hook 66 diametrically opposed from the lever 28 extends away from the collar 24 and is presented for engagement within the catch 58 of the mounting bracket (see FIG. 7). The at least one hook 66 can be resiliently deformable such that the hook can be forced past the catch and thereafter return to an unstressed state.

As best shown in FIG. 12, the dispensing pump 26 is received in the collar 24 and axially aligned therewith such that the nozzle 68 extends beyond the bottom of the collar. The lever 28 includes a substantially planar front face 70 and a nozzle engaging portion 72 extending away from the back side thereof. The lever 28 is pivotally attached near the top edge thereof to the collar 24, as indicated at reference numeral 74. In operation, the lever 28 is urged in the direction of the wall, thereby imparting rotational force on the lever which drives the nozzle engaging portion 72 generally upward to actuate the pump. The nozzle engaging portion 72 includes spaced members 76 defining an elongate slot 78 therebetween. In operation, the tip of the nozzle 68 is able to slide along the slot as the lever 28 is urged toward the wall, thereby avoiding off-axis upward movement of the nozzle that can degrade pump performance. The lever 28 can further be biased in the direction away from the wall, and the point at which the spaced members 76 converge engages the nozzle tip to provide a stop against further return movement of the lever.

Like the disposable cartridge, one or more of the collar and the lever can be completely or partially constructed from suitable biodegradable and/or recyclable materials including, but not limited to, polymers or co-polymers including polyethylene (e.g., HDPE, LDPE, or combinations thereof), polypropylene, polyethylene terephthalate, and combinations thereof. In a particular embodiment, the lever can be partially or completely constructed of at least HDPE, and in most preferred aspects, the lever can be completely constructed of HDPE. In certain aspects, HDPE is preferred due to its structural integrity while also allowing for optimal post-consumer disposal for recycling purposes. These polymers and co-polymers can each have a density preferably ranging from 0.8 to 1.0 g/cm$^3$, 0.85 to 0.95 g/cm$^3$, or 0.9 to 0.95 g/cm$^3$ and a flexural modulus ranging from 1000MPa to 1500 MPa, from 1050 MPa to 1450 MPa, from 1100 MPa to 1400 MPa, 1100 MPa to 1200 MPa, or from 1300 MPa to 1400 MPa.

Figure 14:
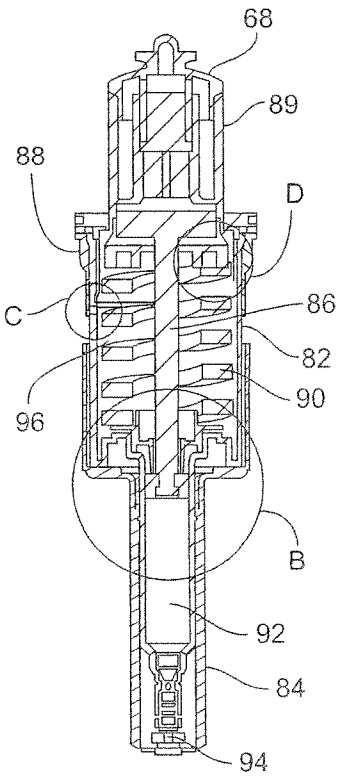
FIG. 14 is a cross-sectional view of the dispensing pump taken along line A-A in FIG. 13.
Figure 15:
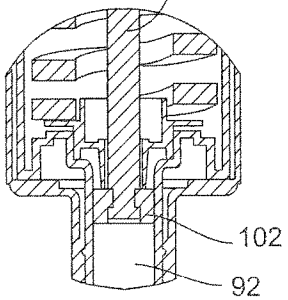
FIG. 15 is a detailed view of region "B" in FIG. 14.
Figure 16:
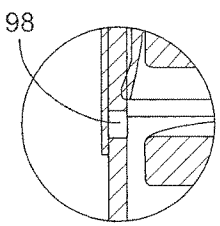
FIG. 16 is a detailed view of region "C" in FIG. 14.

FIGS. 13-17 show a first embodiment of a dispensing pump generally at reference numeral 80. Dispensing pump 80 is preferably an inverted oriented foaming pump generally including a pump body 82, a sleeve 84 received in close-fitting engagement over one end of the pump body, a reciprocating hollow piston 86 disposed within the pump body, a vent gasket 88 received within the end of the pump body opposite the sleeve end, a plunger sleeve 89, the nozzle 68, and a spring 90 arranged to bias the piston. A liquid chamber 92 is provided at one end of the pump body 82 between an end of the piston 86 and a valve 94. Liquid soap from the disposable cartridge can enter the dispensing pump 80 through the sleeve 84, migrate through the space between the pump body 82 and the sleeve, and enter into the liquid chamber 92 through an opening in the end of the pump body sealable by the valve 94. Valve 94 as shown in FIG. 14 can be a ball valve or the like.

Figure 17:
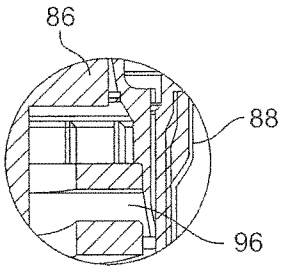
FIG. 17 is a detailed view of region "D" in FIG. 14.

An air chamber 96 is formed within the pump body 82, and an air inlet and air outlet are provided for allowing air to move in and out of the air chamber 96. As shown in FIG. 17 in view of FIG. 16, a vent 98 can be provided through a sidewall of the pump body 82 along with a portion of vent gasket 88 positioned over vent 98 and acting as a vent flap. The vent 98 and portion of the vent gasket 88 positioned there over relived vacuum pressure within the disposable cartridge by acting as a check valve equalizing air pressure within the dispensing pump while concurrently preventing entry of fluid into the pump. The vent 98 can function both to vent the rigid disposable cartridge while also acting as a check valve to reduce and/or eliminate inadvertent soap leakage in the event the lever is held in or stuck in a compressed position.

The vent gasket 88 engages the pump body 82 and can include a circumferential bead 100 for snap-fit engagement with the collar. The circumferential bead 100 can be radially deformable inwardly to engage a bead or deflectable tabs within the collar. Dispensing pump components can be partially or completely constructed of the polymers and co-polymers listed above, and in certain preferred aspects, vent gasket 88 can be made of an elastically deformable material including, but not limited to, natural rubbers, synthetic rubbers, or combinations thereof. Such rubbers can be vulcanizable and can include, for example, Santoprene™ 271-64, Santoprene™ 211-45, or combinations thereof. Such rubbers preferably have a Shore Hardness (i.e., Shore A, 15 sec, 73° F., 0.0787 in) ranging between 35 to 85, 40 to 75, 45 to 55, 60 to 75, and 65 to 70 to ensure optimal rigidity as well as optimal post-consumer disposal for recycling purposes.

A sliding seal 102 is provided at the end of the piston 86 and functions to sweep the inner surface of the liquid chamber 92 as the piston moves axially, thereby forcing liquid soap from the liquid chamber through the hollow piston on the "up" stroke, and drawing liquid soap into the liquid chamber on the "down" stroke, with the "up" and "down" designations corresponding to an inverted orientation of the dispensing pump. Liquid soap is able to move from the liquid chamber 92 to the hollow piston by way of an outlet valve proximate the sliding seal 102. The sliding seal can be made of Santoprene™ or like material, however, is preferably made of LDPE. It was found by the present Applicants that utilizing LDPE as compared to Santoprene™ reduced resistance in the sliding seal, allowed for a quicker return of the piston, and improved durability over a cycle of about 1800-2000 actuations.

Figure 18:
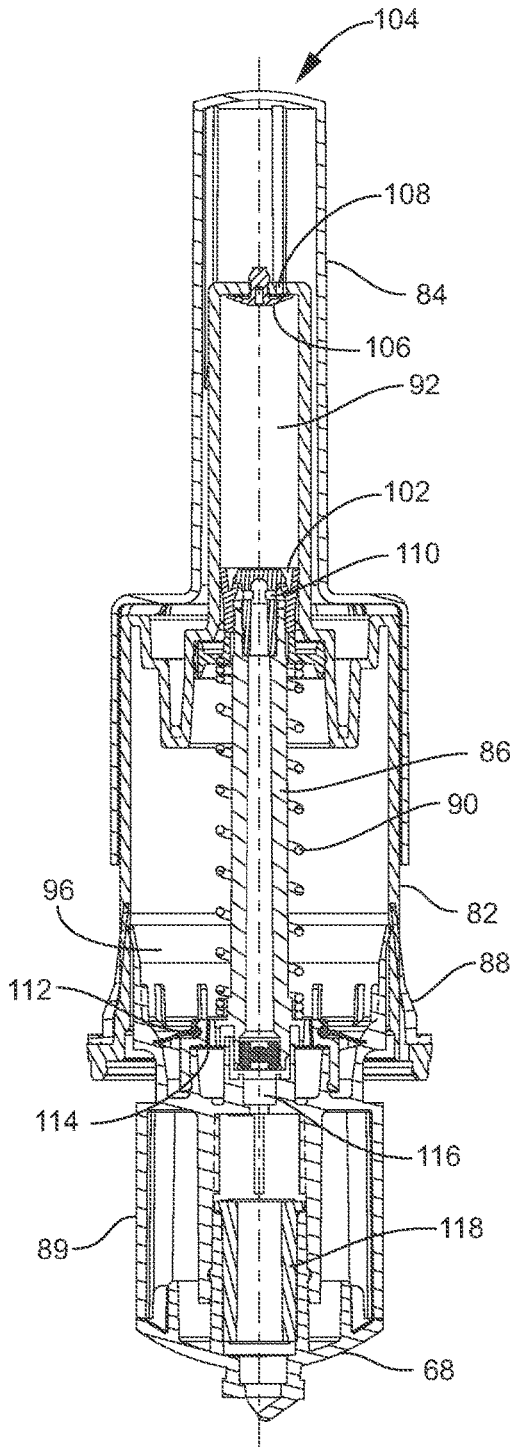
FIG. 18 is a cross-sectional view of a dispensing pump according to a second embodiment.
Figure 19:
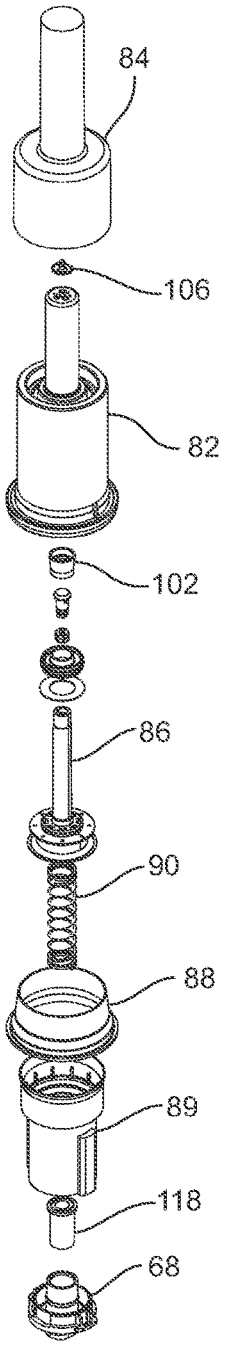
FIG. 19 is an exploded view of the dispensing pump in FIG. 18.

FIGS. 18 and 19 show a second embodiment of a dispensing pump suitable for use in the present soap dispenser generally at reference numeral 104. Like dispensing pump 80, dispensing pump 104 generally includes a pump body 82, sleeve 84 received in close-fitting engagement over one end of the pump body, reciprocating hollow piston 86, sent gasket 88, plunger sleeve 89, nozzle 68, and spring 90.A liquid chamber 92 is provided at one end of the pump body 82 between the sliding seal 102 and the valve 106. Liquid soap can enter the liquid chamber 92 through the inlet opening 108 at the end of the pump body 82. In this second embodiment, the valve 106 is an umbrella valve made of an elastomeric material having a diaphragm-shaped sealing disk positively urged toward a closed position. As arranged, the valve 106 is a one-way valve allowing liquid soap to flow from outside of the liquid chamber 92 into the liquid chamber, while preventing liquid soap from flowing in the opposite direction in the event the nozzle 68 fails to fully return. By mounting the valve 106 in the valve seat from "below", the convex diaphragm flattens against the underside of the seat to maintain a sealing force to prevent flow from the liquid chamber 92 out through the inlet opening 108, The sliding seal 102, preferably made of LIVE, acts in the liquid chamber 92 and liquid soap is able to flow from the liquid chamber into the hollow piston 86 through openings 110 such that the piston is the outlet valve for the liquid soap. An air inlet valve 112 and an air outlet valve 114 are provided near the bottom of the air chamber 96, and can include resiliently flexible flap components. The air inlet valve 112 functions to admit air. During pumping, liquid and air are pumped simultaneously from their respective chambers 92, 96 and meet at a mixing region 116 above a mesh assembly 118. The nozzle 68 can optionally include an anti-drip valve having a slit that opens under a predetermined pressure, and the pump body 82 can include a side vent as discussed above in the first dispensing pump embodiment.

A venting system is provided for equalizing the air pressure within the rigid cartridge 22 to avoid a vacuum condition. In a preferred embodiment, a vent is provided through the sidewall of the pump body 82 (see FIG. 16 at 98) with the vent gasket 88 positioned covering the vent 98. The vent gasket 88 can be made from a resin blend and is an elastomer having elasticity such that vacuum pressure within the disposable cartridge 22 exceeding a predetermined threshold causes air to be drawn in through the vent 98. In response to such a vacuum pressure, the vent gasket 88 deflects apart from the vent 98 as the air is drawn into the disposable cartridge 22 to equalize the air pressure therein. Once the air pressure is equalized or drops below the predetermined threshold, the vent gasket 88 returns to its original shape and again covers and seals the vent 98, thereby preventing liquid soap from entering into the internal air chamber 96. Thus, the vent gasket 88 functions as a check valve, allowing air to flow only in the direction into the rigid cartridge 22.

Figure 20:
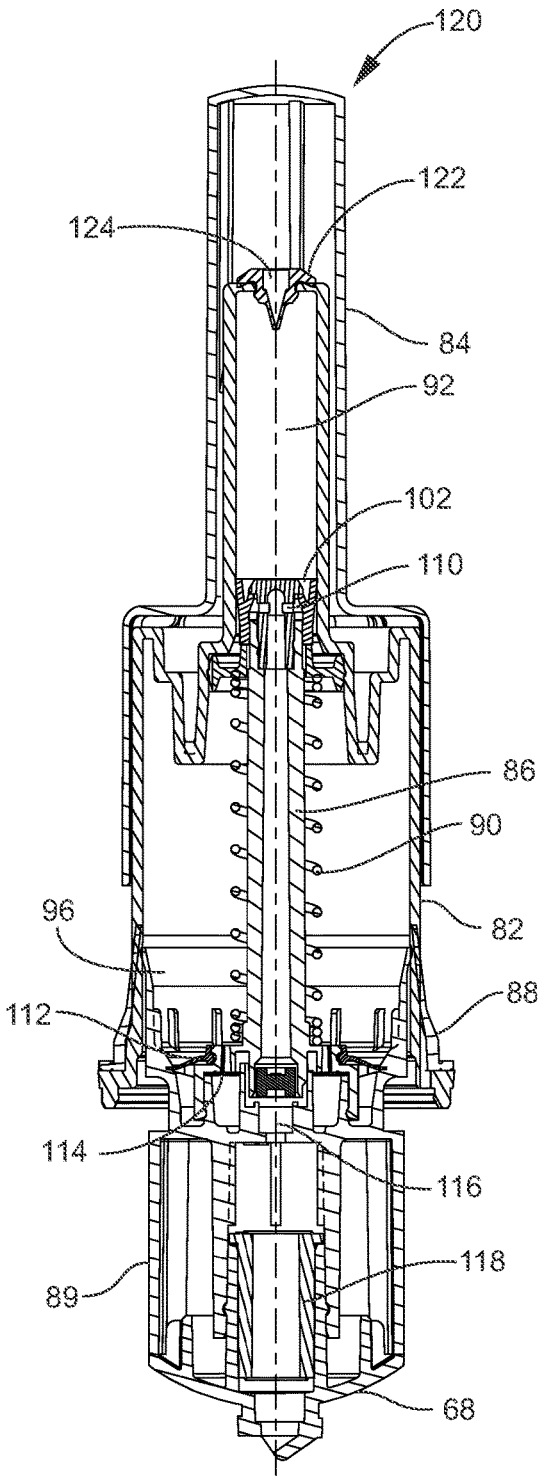
FIG. 20 is a cross-sectional view of a dispensing pump according to a third embodiment.
Figure 21:
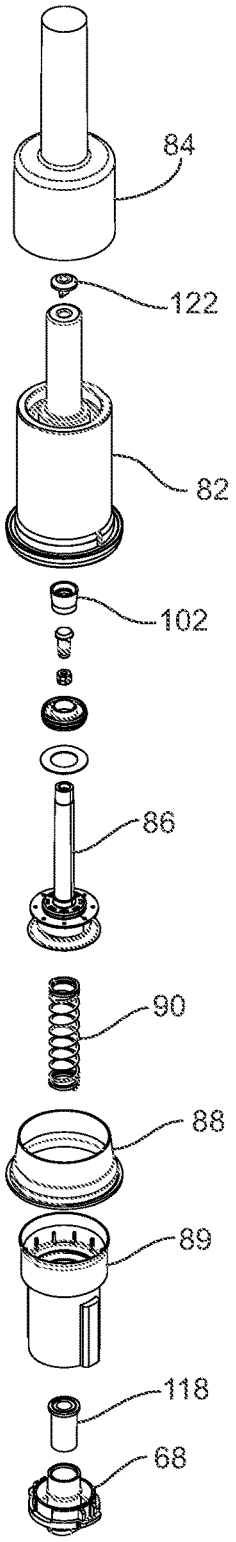
FIG. 21 is an exploded view of the dispensing pump in FIG. 20.

FIGS. 20 and 21 show a third embodiment of a dispensing pump suitable for use in the present soap dispenser generally at reference numeral 120. The pump components are generally the same as those in the second embodiment, with the exception of the valve 122, therefore like parts are numbered accordingly. Valve 122 is a duckbill valve made of an elastomeric material. The valve 122 is inserted from "above" and seats within an opening through the end of the pump body 82. The valve 122 has a central passageway 124. The duckbill or "bottom" end of the valve 122 retains a natural flattened and closed shape, thereby preventing backflow out of the liquid chamber 92. When liquid soap is drawn into the liquid chamber 92 on the piston "down" stroke, the flattened duckbill end opens to permit the liquid soap to pass through the valve 122 from "above".

Dimensions, manners of engagement, and sealing engagements of the various dispensing pump components other than those shown are envisioned and contemplated. For example, air and liquid chamber volumes can be tailored to dispense any predetermined metered amount of foam soap. Thus, the foregoing description is intended to provide embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A soap dispenser, comprising:

a mounting bracket having a lip and a catch at opposite ends thereof;

a rigid disposable cartridge having a neck end, an elongate recess formed in a backside, and a catch formed at one end of the elongate recess, the catch of the rigid disposable cartridge is configured to engage and completely conceal the lip of the mounting bracket within the elongate recess on the backside of the rigid disposable cartridge when the soap dispenser is assembled;

a collar adapted to engage with the catch of the mounting bracket and engage with the neck end of the disposable cartridge;

an inverted dispensing pump received within the neck end of the disposable cartridge and adapted to engage within the collar; and a lever attached to and carried by the collar, the lever arranged to actuate the inverted dispensing pump to cause the inverted dispensing pump to dispense foam soap.

2. The soap dispenser according to claim 1, wherein the lip, the catch formed at one end of the elongate recess, the collar, and the catch of the mounting bracket together are used to removably secure the disposable cartridge to the mounting bracket.

3. The soap dispenser according to claim 1, wherein the mounting bracket is an elongate member and is affixed to a plate for spacing the disposable cartridge apart from a wall.

4. The soap dispenser according to claim 1, further comprising a sloped protrusion formed on the backside of the disposable cartridge within the elongate recess that engages within a complementary-shaped sloped recess formed in a front face of the mounting bracket.

5. The soap dispenser according to claim 1, wherein the collar comprises at least one laterally extending hook adapted to horizontally engage with the catch of the mounting bracket, and wherein the lever is pivotally carried on the collar, engages an end of a nozzle of the inverted dispensing pump, and pivots to urge the nozzle axially upward.

6. The soap dispenser according to claim 1, wherein the inverted dispensing pump comprises a vent gasket arranged around an end of a pump body having an internal air chamber, the vent gasket covering a vent opening through a sidewall of the pump body, the vent gasket being an elastomer such that vacuum pressure within the rigid disposable cartridge causes the vent gasket to deflect apart from the vent and air to be drawn in through the vent into the rigid disposable cartridge to equalize air pressure therein.

7. The soap dispenser according to claim 6, wherein the pump body comprises a valve at one end thereof for drawing liquid soap into a fluid chamber, wherein the valve is an umbrella valve or a duckbill valve.

8. The soap dispenser according to claim 7, wherein the air chamber and the liquid chamber are formed within the pump body and are separated by a piston having a sliding seal, and wherein a fluid inlet allows liquid soap to enter into the liquid chamber through the valve, an air inlet valve allows air to enter into the air chamber, and an air outlet valve allows air to exit the air chamber.

9. The soap dispenser according to claim 8, wherein the sliding seal is made of low density polyethylene.

10. The soap dispenser according to claim 1, wherein the disposable cartridge is made of a recyclable and/or biodegradable material.

11. A soap dispenser, comprising:

a rigid cartridge having an internal reservoir adapted to contain a volume of liquid soap;

a collar adapted to removably attach to a neck end of the rigid cartridge;

an inverted dispensing pump held within the collar and received within the neck end of the rigid cartridge; and a lever attached to and carried by the collar, the lever arranged to actuate the inverted dispensing pump to cause the inverted dispensing pump to dispense foam soap;

wherein the inverted dispensing pump comprises a vent gasket arranged around an end of a pump body having an internal air chamber, the vent gasket covering a vent opening through a sidewall of the pump body, the vent gasket being an elastomer such that vacuum pressure within the rigid disposable cartridge as a result of liquid soap removal causes the vent gasket to deflect apart from the vent and air to be drawn in through the vent into the rigid cartridge to equalize air pressure therein;

a mounting bracket adapted to be received in a recess on a backside of the rigid cartridge, the mounting bracket comprises a lip that engages and is concealed within the recess of the rigid cartridge and a catch at opposite ends thereof for engaging with a respective catch on the backside of the rigid cartridge and a feature on the collar to cooperatively secure an assembled configuration of the rigid cartridge, the inverted dispensing pump, and the collar to the mounting bracket.

12. The soap dispenser according to claim 11, wherein the mounting bracket is an elongate member and is affixed to a plate for spacing the rigid cartridge apart from a wall to which the plate is affixed.

13. The soap dispenser according to claim 11, wherein the inverted dispensing pump further comprises:

a valve at one end of the pump body for drawing the liquid soap into an internal fluid chamber within the pump body;

a sleeve received over the valve end of the pump body;

a piston disposed within the pump body and having a sliding seal, the piston and the sliding seal separating the air chamber from the fluid chamber;

a spring arranged to bias the piston;

a plunger sleeve;

a mesh assembly; and a nozzle.

14. The soap dispenser according to claim 13, wherein the sliding seal is made of low density polyethylene.

* * * * *